US006239546B1

(12) United States Patent
Wada et al.

(10) Patent No.: US 6,239,546 B1
(45) Date of Patent: May 29, 2001

(54) COLOR CATHODE RAY-TUBE WITH ELECTRON GUN HAVING A REINFORCING ELECTRODE

(75) Inventors: Yasufumi Wada; Yasuyuki Yamamoto, both of Osaka; Masao Natsuhara, Shiga, all of (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/181,538

(22) Filed: Oct. 28, 1998

(30) Foreign Application Priority Data

Nov. 4, 1997 (JP) ..... 9-301513

(51) Int. Cl.[7] ..... H01J 29/46
(52) U.S. Cl. ..... 313/456; 313/414; 313/451
(58) Field of Search ..... 313/441, 442, 313/444, 446, 449, 451, 452, 456, 411, 412, 414

(56) References Cited

U.S. PATENT DOCUMENTS 5,142,189 8/1992 Sugahara et al. ..... 313/414
5,235,241 * 8/1993 Van Eck et al. ..... 313/414
5,656,884 * 8/1997 Lee ..... 313/412
5,661,363 * 8/1997 Iguchi et al. ..... 313/412
5,932,958 * 8/1999 Watanabe et al. ..... 313/412

FOREIGN PATENT DOCUMENTS 4-133247 5/1992 (JP) .

* cited by examiner

*Primary Examiner*—Vip Patel
*Assistant Examiner*—Joseph Williams
(74) *Attorney, Agent, or Firm*—Merchant & Gould P.C.

(57) ABSTRACT

A reinforcing electrode plate having at least one electron-beam through-hole that passes an electron beam is connected to at least one of a focusing electrode and a final accelerating electrode at its opening portion. Supporting portions of the reinforcing electrode plate are formed so as to project further outside than the opening portion or the peripheral face of the electrode, thus fixing the reinforcing electrode plate to an insulating support. Therefore, the deformation of the focusing electrode or the final accelerating electrode that occurs in assembling a main lens of an electron gun used for a color cathode-ray tube is prevented, thus decreasing the variation in property of the electron gun. Additionally, by adjusting the shape or the like of an opening through which an electron beam passes in the reinforcing electrode plate, a focusing power of the main lens can be adjusted in the horizontal direction and in the vertical direction.

4 Claims, 14 Drawing Sheets

COLOR CATHODE RAY-TUBE WITH ELECTRON GUN HAVING A REINFORCING ELECTRODE

FIELD OF THE INVENTION

The present invention relates to a color cathode-ray tube, and more particularly to a configuration of electrodes forming a main lens of an electron gun.

BACKGROUND OF THE INVENTION

Generally, a color cathode-ray tube apparatus has an envelope comprised of a panel and a funnel joined to the panel to form one component. Three electron beams emitted from an electron gun arranged inside a neck of the funnel are deflected by horizontal and vertical deflection magnetic fields generated by a deflector mounted outside the funnel. While scanning horizontally and vertically, the three electron beams strike a phosphor screen formed on the inner face of the panel so as to oppose a shadow mask. Thus, the color cathode-ray tube apparatus displays color images.

In such a color cathode-ray tube apparatus, in order to display images with high resolution on the phosphor screen, it is necessary to make a spot diameter on the phosphor screen as small as possible by reducing the effect of spherical aberration through enlarging the effective lens aperture of a main lens in the electron gun.

A main lens of an electron gun used for a conventional color cathode-ray tube is described, for example, in Unexamined Japanese Patent Application No. Tokkai Hei 3-152834 and Unexamined Japanese Patent Application No. Tokkai Hei 4-133247. As shown in FIG. 14, the main lens is comprised of a focusing electrode 13 with an end face (a bottom 13*c*) and a final accelerating electrode 14 with an end face (a bottom 14*c*) adjacent to the focusing electrode 13. The end face of the focusing electrode 13 and that of the final accelerating electrode 14 oppose each other. Each end face has an oblong electron-beam through-hole having its major axis in the horizontal direction. The main lens contains field forming electrode plates 13*a* and 14*a*, each of which has three electron-beam through-holes at the position recessed from its end face.

The focusing electrode 13 is welded on a surface 74 contacting with an auxiliary focusing electrode 12 on a cathode side. The focusing electrode 13 is fixed to an insulating support 21 (made of weld glass bead) through bracket portions 75 formed on the upper and lower faces of the auxiliary focusing electrode 12 in the vertical direction or through buried portions 76 formed on the upper and lower faces of the focusing electrode 13 in the vertical direction. The final accelerating electrode 14 is fixed to the insulating support 21 through bracket portions 77 or buried portions 78 formed on its upper and lower faces in the vertical direction.

The focusing electrode 13 and the final accelerating electrode 14 are fixed to the insulating support 21 by heating the insulating support 21 to a high temperature to soften it and forcing the bracket portions 75 and 77 or the buried portions 76 and 78 into the insulating support 21.

At that time, an opening 13*b* of the focusing electrode 13 is subject to a force. Therefore, while the length of the opening 13*b* decreases in the vertical direction, the length of an opening at the bottom 13*c* of the focusing electrode 13 increases in the vertical direction. In this case, the field forming electrode plate 13*a* functions as a supporting point. Consequently, the focusing power of the main lens in the vertical direction decreases while that in the horizontal direction increases. Thus, an electron beam spot that should be focussed on a phosphor screen optimally (in a just-focusing condition) is in an over-focusing condition in the horizontal direction and in an under-focusing condition in the vertical direction. As a result, there has been a problem that the spot of an electron beam on the screen increases in diameter or is distorted.

The difference between the focus condition in the horizontal direction and that in the vertical direction varies depending on how a force is applied in forcing the focusing electrode 13 into the insulating support 21, thus causing variations in every cathode-ray tube.

The same problem may also occur in fixing the final accelerating electrode 14 to the insulating support 21.

SUMMARY OF THE INVENTION

The present invention aims to solve such problems. In the present invention, when fixing a focusing electrode and a final accelerating electrode to an insulating support, a force to which bracket portions or buried portions of the focusing electrode and the final accelerating electrode are subjected is reduced, thus preventing the deformation of the focusing electrode and the final accelerating electrode.

In order to attain the above-mentioned object, the present invention employs the following configuration.

A color cathode-ray tube of the present invention comprises an electron gun having a main lens. The main lens comprises a focusing electrode and a final accelerating electrode, each of which has an opening portion on one end and a bottom having an electron-beam through-hole on the other end. The focussing electrode and the final accelerating electrode are arranged with their bottoms opposing each other at a predetermined distance. At least one of the focussing electrode and the final accelerating electrode has an field forming electrode plate and a reinforcing electrode plate. The field forming electrode plate is provided inside the electrode at a position recessed from its bottom. The reinforcing electrode plate has at least one opening through which an electron beam passes and is connected to the opening portion side. The reinforcing electrode plate has a supporting portion and is fixed to an insulating support with the supporting portion projecting further outside than a peripheral surface of the opening portion.

Therefore, when fixing the focusing electrode and the final accelerating electrode to the insulating support, the reinforcing electrode plate absorbs the force to which the bracket portions or the buried portions are subjected, thus preventing the deformation of the focusing electrode and the final accelerating electrode.

In the configuration described above, the reinforcing electrode plate may have only one opening through which a center electron beam out of three electron beams passes. Additionally, both sides of the reinforcing electrode plate may be formed in a nearly circular-arc shape, and the each portion having the nearly circular-arc shape may partially surround the electron beam located at each side of the center electron beam respectively.

Further, in the configuration described above, the reinforcing electrode plate may have a hood adjacent at least one of the three electron beams. The hood projects forward or backward with respect to the traveling direction of the electron beam.

These structures enable a spot diameter on a phosphor screen to be adjusted by adjusting an electric field lens using a reinforcing electrode plate.

DETAILED DESCRIPTION OF THE INVENTION

Embodiment 1

Figure 3:
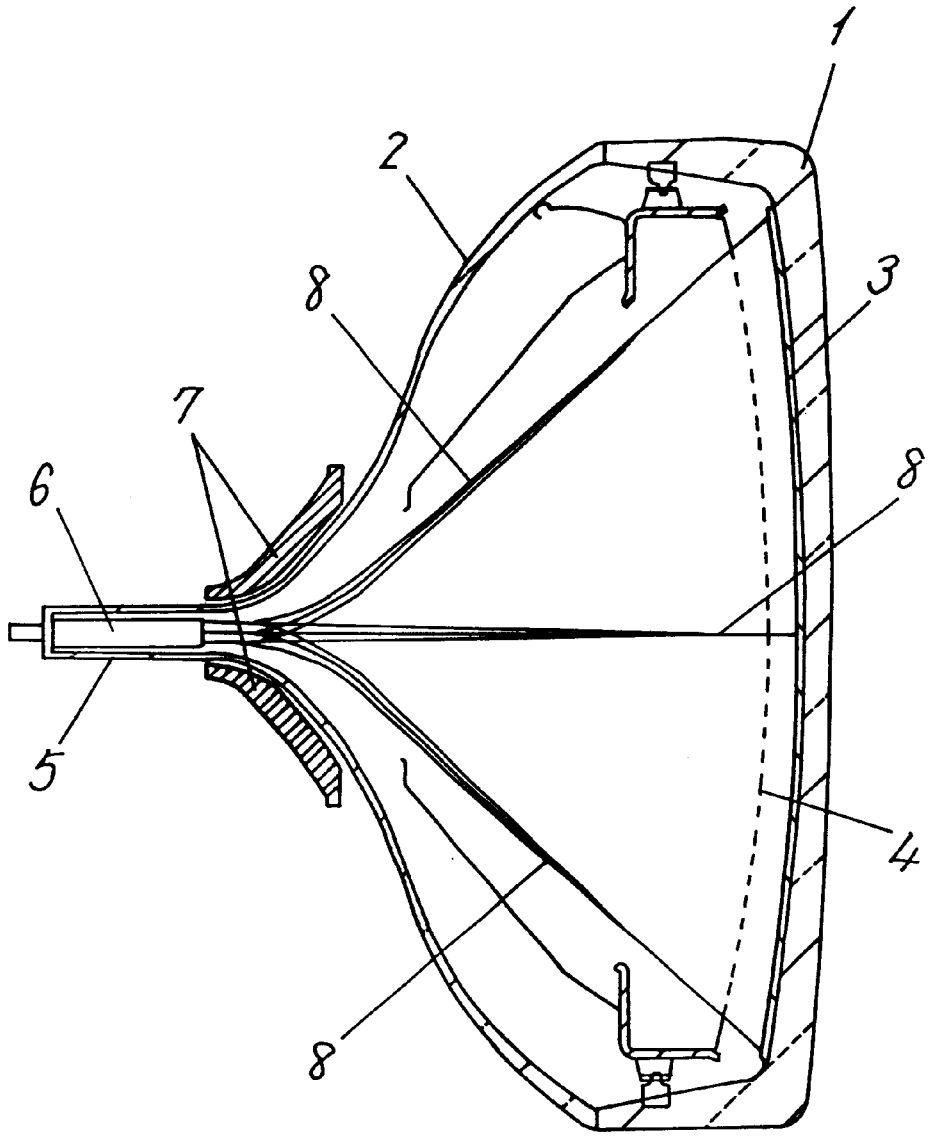
FIG. 3 is a sectional side view of a color cathode-ray tube apparatus using a color cathode-ray tube of the present invention.

FIG. 3 shows a color cathode-ray tube apparatus in which a deflection yoke is combined with a color cathode-ray tube of the present invention.

This color cathode-ray tube apparatus has an envelope comprised of a panel 1 and a funnel 2 joined to the panel 1 to form one component. A phosphor screen 3 made of a three-color phosphor layer emitting blue, green, and red lights is formed on the inner face of the panel 1. A shadow mask 4 in which many electron-beam through-holes are formed is arranged at a predetermined distance from the phosphor screen 3. An electron gun 6 is located inside a neck portion 5 of the funnel 2. A deflection yoke 7 is mounted on the boundary portion between the neck portion 5 and a large-diameter portion of the funnel 2. The deflection yoke 7 deflects electron beams 8 emitted from the electron gun 6 in horizontal and vertical directions.

Figure 2:
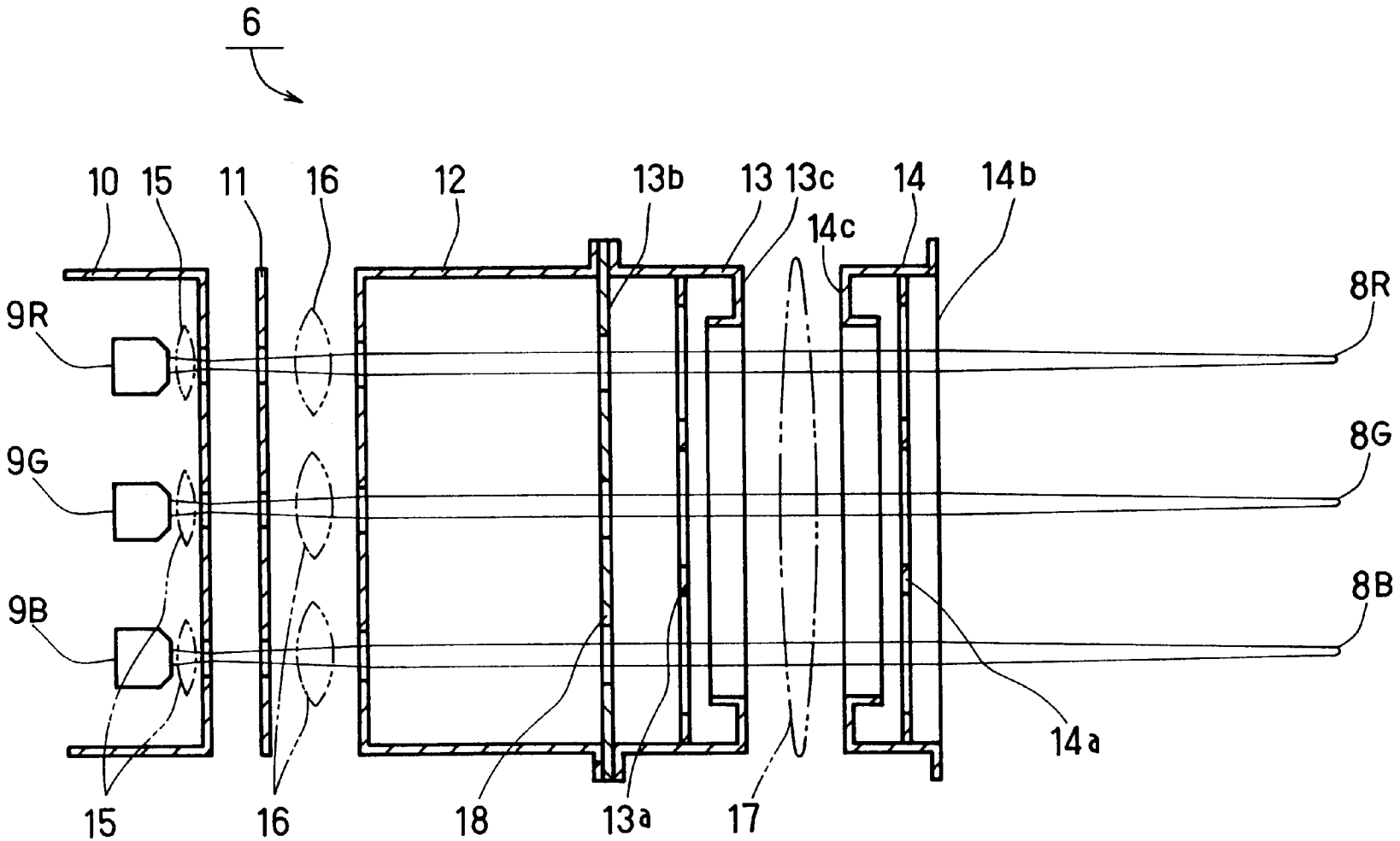
FIG. 2 is a conceptual diagram of a plan cross-section of the electron gun.

FIG. 2 is a conceptual diagram showing a plan cross-section of an electron gun used in a color cathode-ray tube of the present invention. An electron gun 6 comprises three cathodes 9R, 9G, and 9B having an in-line alignment in a horizontal direction, a control lattice electrode 10, an accelerating electrode 11, an auxiliary focusing electrode 12, a reinforcing electrode plate 18, a focusing electrode 13, and a final accelerating electrode 14 sequentially.

A cathode lens 15 formed by the cathodes 9R, 9G, and 9B, the control lattice electrode 10, and the accelerating electrode 11 derives electron beams 8R, 8G, and 8B from the cathodes 9R, 9G, and 9B. The electron beams 8R, 8G, and 8B are focused on a phosphor screen 3 by a pre-focusing lens 16 and a main lens 17. The pre-focusing lens 16 is formed by the accelerating electrode 11 and the auxiliary focusing electrode 12. The main lens 17 is formed by the focusing electrode 13 and the final accelerating electrode 14.

The main lens 17 comprises the cup-type focusing electrode 13 and the cup-type final accelerating electrode 14. The focusing electrode 13 has an opening portion 13*b* on one end and a bottom 13*c* provided with one through-hole common for three electron beams on the other end. The final accelerating electrode 14 has an opening portion 14*b* on one end and a bottom 14*c* provided with one through-hole common for the three electron beams on the other end. The focusing electrode 13 and the final accelerating electrode 14 are arranged at a predetermined distance with the bottoms 13*c* and 14*c* facing each other. Each of field forming electrode plates 13*a* and 14*a* having three electron-beam through-holes is arranged at a position recessed from each bottom of the focusing electrode 13 and the final accelerating electrode 14 respectively. In the present embodiment, an field forming electrode plate is provided to both the focusing electrode 13 and the final accelerating electrode 14. However, the present invention is not limited to this configuration. The field forming electrode plate may be provided inside any one of the electrodes 13 and 14. The main lens 17 is formed by the interaction between the field forming electrode plate and the electron-beam through-hole provided at the bottom of the focusing electrode 13 or the final accelerating electrode 14. Therefore, even if the field forming electrode plate is provided for only one of the focusing electrode 13 and the final accelerating electrode 14 and the other electrode has another configuration, the main lens 17 can be formed.

In the embodiment mentioned above, three electron-beam through-holes are provided for the field forming electrode plate. However, the present invention is not limited to this. Needless to say, an excellent main lens for three electron-beams can be formed by providing at least one electron-beam through hole.

A reinforcing electrode plate 18 is connected to the focusing electrode 13 at the opening portion 13*b* side. The reinforcing electrode plate 18 is provided with at least one electron-beam through-hole for passing three electron beams.

Next, a reference is made to a reinforcing electrode plate.

Figure 1:
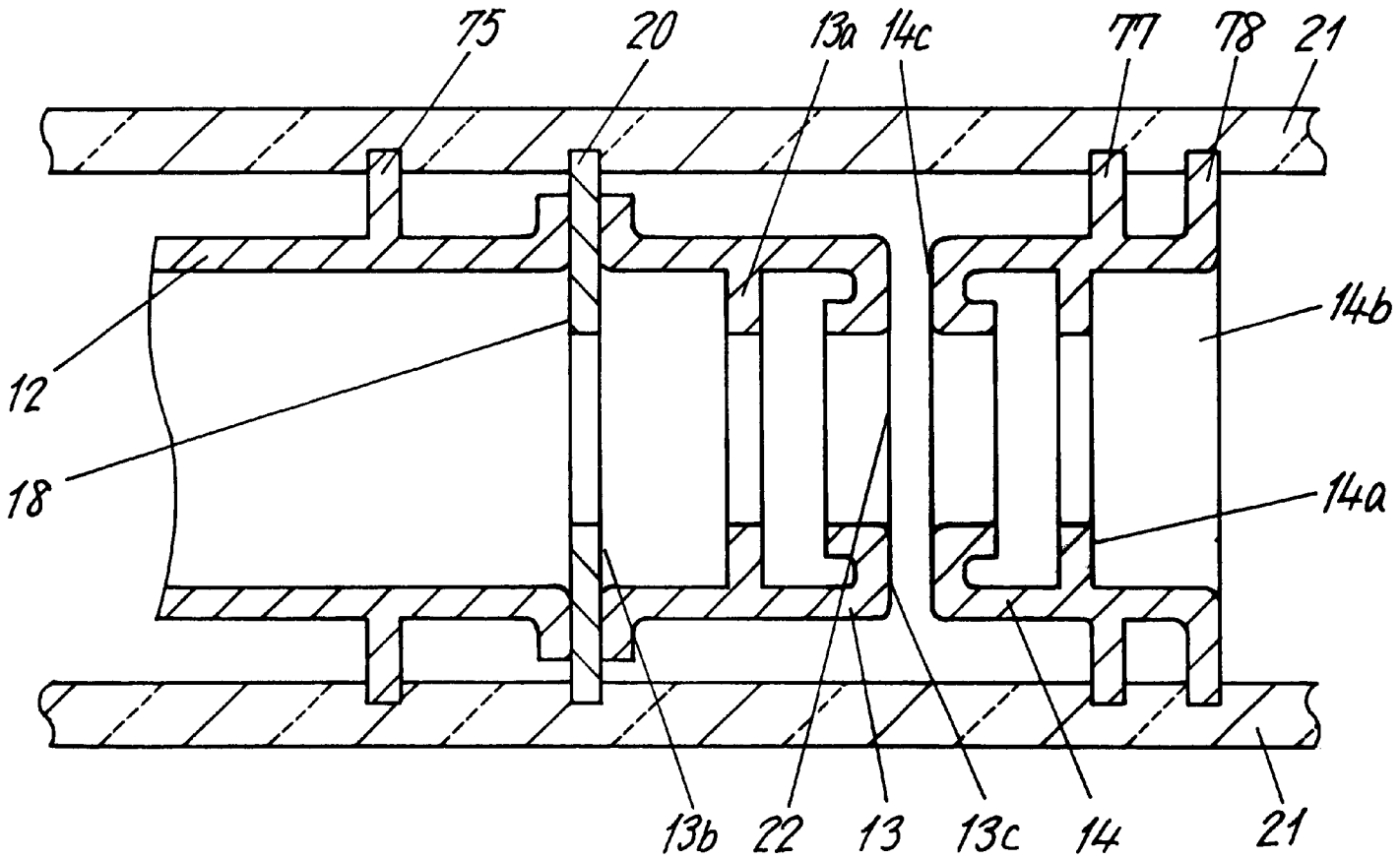
FIG. 1 is a sectional side view of an important part of an electron gun used in a color cathode-ray tube of the present invention.

FIG.1 shows a sectional side view of the electron gun 6. The reinforcing electrode plate 18 is sandwiched between the opening portion 13*b* of the focusing electrode 13 and the auxiliary focusing electrode 12 and is electrically connected to the focusing electrode 13 and the auxiliary focusing electrode 12 by welding or the like. A supporting portion 20 (a buried portion) of the reinforcing electrode plate 18 is fixed to an insulating support 21 with the supporting portion 20 projecting further outside than a peripheral surface of the opening portion 13*b* of the focusing electrode 13. The focussing electrode 13 is not held directly by the insulating support 21.

Figure 4:
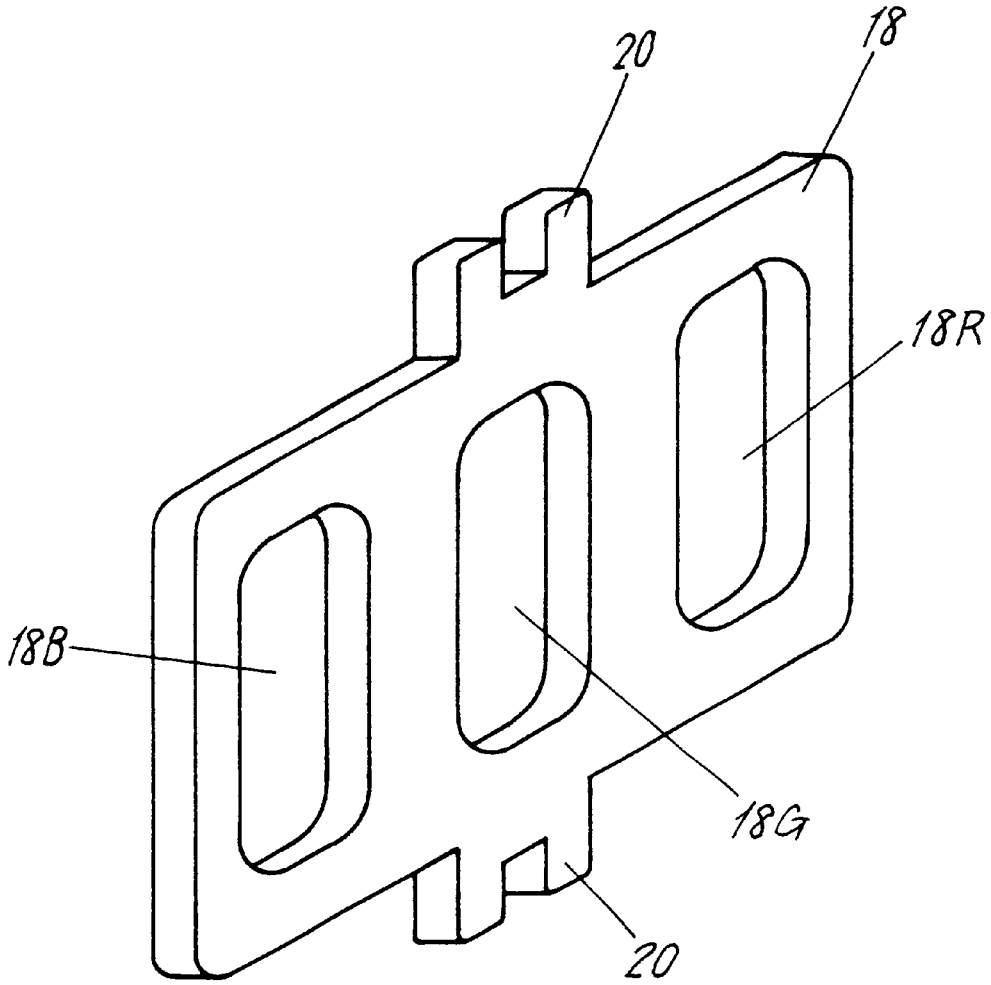
FIG. 4 is a perspective view of an example of a reinforcing electrode plate according to the present invention.

As shown in FIG. 4, three openings 18R, 18G, and 18B through which electron beams 8R, 8G, and 8B pass respectively are formed in the reinforcing electrode plate 18. A pair of supporting portions 20 also are formed.

By providing such a reinforcing electrode plate 18, when the focusing electrode 13 is fixed to the insulating support 21, a force to which the focusing electrode 13 is subjected can be absorbed by the reinforcing electrode plate 18.

Therefore, such a conventional problem as described below does not occur. That is, conventionally, the length of the opening portion 13*b* in the vertical direction has decreased, and at the same time the length of the opening portion of the bottom 13*c* of the focusing electrode 13 in the vertical direction has increased with the field forming electrode plate 13*a* functioning as a supporting point.

Thus, the following conventional problem does not occur. That problem is, the focusing power of the main lens decreases in the vertical direction while it increases in the horizontal direction, and therefore a spot of the electron beam is in an over-focusing condition in the horizontal direction and in an under-focusing condition in the vertical direction on a phosphor screen, thus enlarging or distorting the spot of the electron beam on the screen. Additionally, variations in focussing conditions in the horizontal and vertical directions between individual cathode-ray tubes do not occur.

When any one of the focusing electrode 13 and the final accelerating electrode 14 is not provided with the field forming electrode plate 13*a* or 14*a* respectively, it is not always necessary to provide the reinforcing electrode plate 18 to such a focusing electrode 13 or such a final accelerating electrode 14. On the other hand, when both the focusing electrode 13 and the final accelerating electrode 14 have the field forming electrode plate 13*a* and 14*a* respectively as in the present embodiment, it is preferable to provide the reinforcing electrode plate 18 to both the opening portions 13*b* and 14*b* of the focusing electrode 13 and of the final accelerating electrode 14 respectively. However, depending on the degree of deformation of the opening portions 13*b* and 14*b* and of deformation of the electron-beam through-holes provided at the bottoms 13*c* and 14*c* of the focusing electrode 13 or the final accelerating electrode 14 respectively to which the reinforcing electrode plate 18 is not provided, it is practically acceptable in some cases that the reinforcing electrode plate 18 may be provided only to the opening portion of one of the electrodes 13 and 14. When the reinforcing electrode plate 18 is connected to the opening portion 14b of the final accelerating electrode 14, one of the bracket portion 77 and the buried portion 78 is not necessary or both of them are not required.

Various shapes of openings provided for the reinforcing electrode plate will be explained as follows.

Generally, a lens electric field of an electric field lens has an effect on a range corresponding to the distance about twice the aperture of the electric field lens in a traveling direction of electron beams. In an electron gun according to the present invention, a reinforcing electrode plate 18 is arranged at a position about 7–8 mm away from a main lens 17 having an aperture of about 6.5 to 10.0 mm. Consequently, the presence and the shape of the reinforcing electrode plate affects the electric field generated by the main lens, while the reinforcing electrode plate itself forms an electric field lens, thus affecting the electric field of the main lens. Therefore, it is necessary to adjust the shapes of the reinforcing electrode plate and of the openings suitably according to a desired lens electric field.

Figure 5:
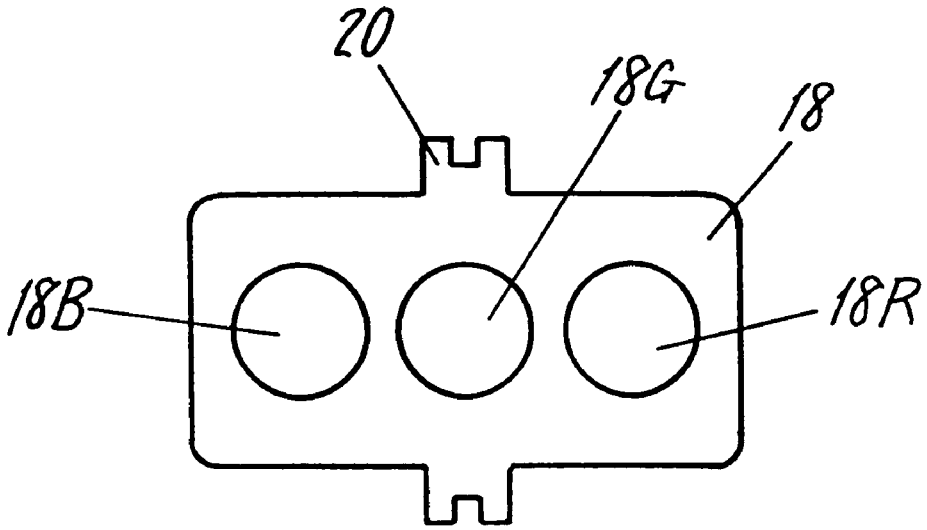
FIG. 5 is a plan view of another example of the reinforcing electrode plate.

As shown in FIG. 5, when the center opening 18G out of three openings is formed so as to have the same width in a horizontal direction and in a vertical direction, that is, so as to be a circle, the electric field lens formed by the reinforcing electrode plate 18 has an effect on the center electron beam 8G equally in the horizontal direction and in the vertical direction. As a result, a spot in a just-focusing condition can be obtained on a phosphor screen.

This configuration is particularly suitable for a color cathode-ray tube used for a computer monitor, HDTV, and the like that require a high image quality. Generally, a magnetic field generated from a deflection yoke in a horizontal direction is different from that in the vertical direction. Therefore, the focusing power generated by the magnetic field acting on an electron beam in the horizontal direction is different from that in the vertical direction. However, in an electron gun of a color cathode-ray tube that requires a high image quality, the formation of a quadrupole lens compensates for the difference. Therefore, it is necessary that the main lens has the same focusing power in the horizontal direction and in the vertical direction.

The shape of the opening 18G may be square or polygon having five sides or more besides circle.

On the other hand, in the openings 18R and 18B located at each side of the center opening 18G, when the width of each opening in the horizontal direction is substantially the same as that in the vertical direction, the side electron beams 8R and 8B are affected equally in the horizontal direction and in the vertical direction by the electric field lens of the reinforcing electrode plate 18.

Figure 6:
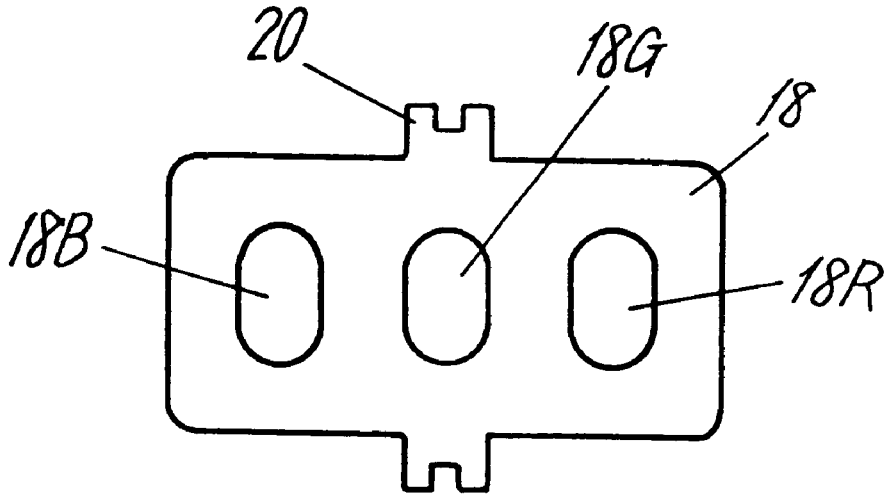
FIG. 6 is a plan view of still another example of the reinforcing electrode plate.

As shown in FIG. 6, if the width of the center opening 18G in the horizontal direction is made to be narrower than that in the vertical direction and the reinforcing electrode plate 18 is connected to the focusing electrode 13 at the opening portion 13*b* side as shown in FIG. 1, the focusing power affecting the center electron beam 8G in the horizontal direction can be strengthened compared to that in the vertical direction. On the contrary, when the reinforcing electrode plate 18 having the same shape is connected to the final accelerating electrode 14 at the opening portion 14*b* side, the focusing power affecting the center electron beam 8G in the horizontal direction can be weakened compared to that in the vertical direction.

The former configuration is suitable for a color cathode-ray tube using a quadrupole lens. A normal quadrupole lens has no lens function of acting on the electron beam heading toward the center of the phosphor screen. On the other hand, the normal quadrupole lens has the lens function of acting on the electron beams heading for the circumferential part of the phosphor screen. However, recently, in order to decrease the dynamic voltage for generating the quadrupole lens or the variation in spot at the circumferential part of the phosphor screen, an electron gun that has the lens function of acting at the center and has no lens function at the circumferential part, which functions in an opposite manner to the normal quadrupole lens, has come into practical use. In such an electron gun, in order to obtain a just-focusing condition at the center of the phosphor screen, it is necessary to compensate for the lens function by making the focusing power of the main lens in the horizontal direction stronger than that in the vertical direction. According to the present configuration, such compensation easily can be provided by making the width of the opening of the reinforcing electrode plate in the horizontal direction smaller than that in the vertical direction.

Additionally, this configuration is also suitable for a color cathode-ray tube that does not require a high image quality. In such a color cathode-ray tube, instead of a quadrupole lens, a compromise design is employed. In the compromise design, spot shapes at the center and at the circumferential part of the phosphor screen are in an under-focusing condition and in an over-focusing condition, respectively. In this case, the focusing power of a main lens is set to be strong in the horizontal direction and weak in the vertical direction. For this purpose, any one of the following methods is used. One is a method of generating a desired lens electric field through the design of the main lens itself, and the other is a method of obtaining a desired lens electric field by providing an additional lens or an additional electrode while keeping the focusing power of the main lens equal in the horizontal direction and in the vertical direction. However, it is very difficult to design the main lens in the former method, and thus the design cannot be modified easily. Therefore, conventionally the latter has been applied in general. According to the present invention, a desired lens electric field can be generated by only adjusting the shape of the openings in the reinforcing electrode plate suitably. Consequently, it is advantageous that the main lens can be easily designed and modified.

The shape of the opining 18G may be an ellipse, rectangle, and polygon having five sides or more besides oval.

On the other hand, when the width of the side openings 18R and 18B in the horizontal direction is made to be smaller than that in the vertical direction and the reinforcing electrode plate 18 is connected to the focusing electrode 13 at the opening portion 13*b* side, the focusing power affecting the side electron beams 8R and 8B in the horizontal direction can be strengthened compared to that in the vertical direction. On the contrary, when the reinforcing electrode plate 18 having the same shape is connected to the final accelerating electrode 14 at the opening portion 14*b* side, the focusing power affecting the side electron beams 8R and 8B in the horizontal direction can be weakened compared to that in the vertical direction.

Figure 7:
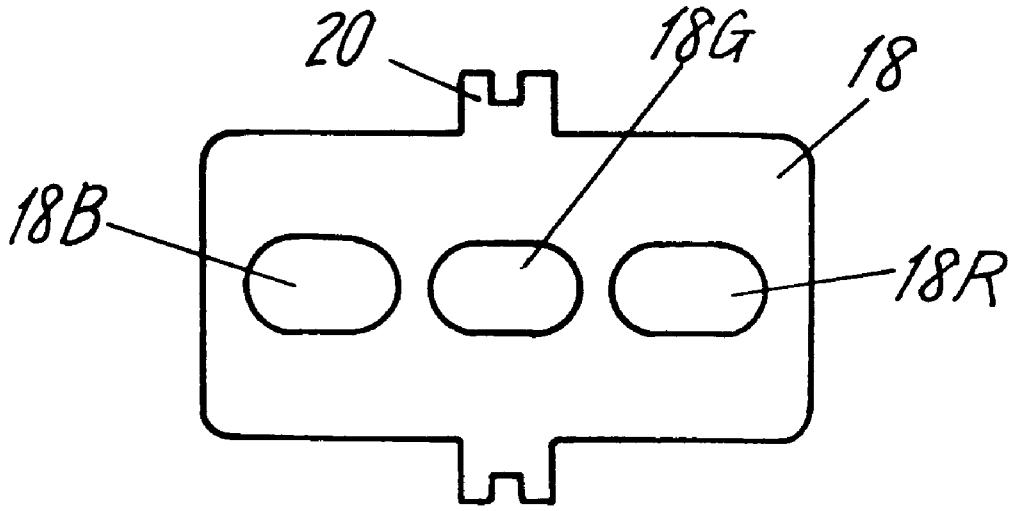
FIG. 7 is a plan view of yet another example of the reinforcing electrode plate.

As shown in FIG. 7, when the width of the center opening 18G in the horizontal direction is made to be larger than that in the vertical direction and the reinforcing electrode plate 18 is connected to the focusing electrode 13 at the opening portion 13*b* side, the focusing power affecting the center electron beam 8G in the horizontal direction can be weakened compared to that in the vertical direction. On the contrary, when the reinforcing electrode plate 18 having the same shape is connected to the final accelerating electrode 14 at the opening portion 14*b* side, the focusing power affecting the center electron beam 8G in the horizontal direction can be strengthened compared to that in the vertical direction.

The shape of the opining 18G may be an ellipse, rectangle, and polygon having five sides or more besides oval.

On the other hand, when the width of the side openings 18R and 18B in the horizontal direction is made to be larger than that in the vertical direction and the reinforcing electrode plate 18 is connected to the focusing electrode 13 at the opening portion 13*b* side, the focusing power affecting the side electron beams 8R and 8B in the horizontal direction can be weakened compared to that in the vertical direction. On the contrary, when the reinforcing electrode plate 18 having the same shape is connected to the final accelerating electrode 14 at the opening portion 14*b* side, the focusing power affecting the side electron beams 8R and 8B in the horizontal direction can be strengthened compared to that in the vertical direction.

Figure 8:
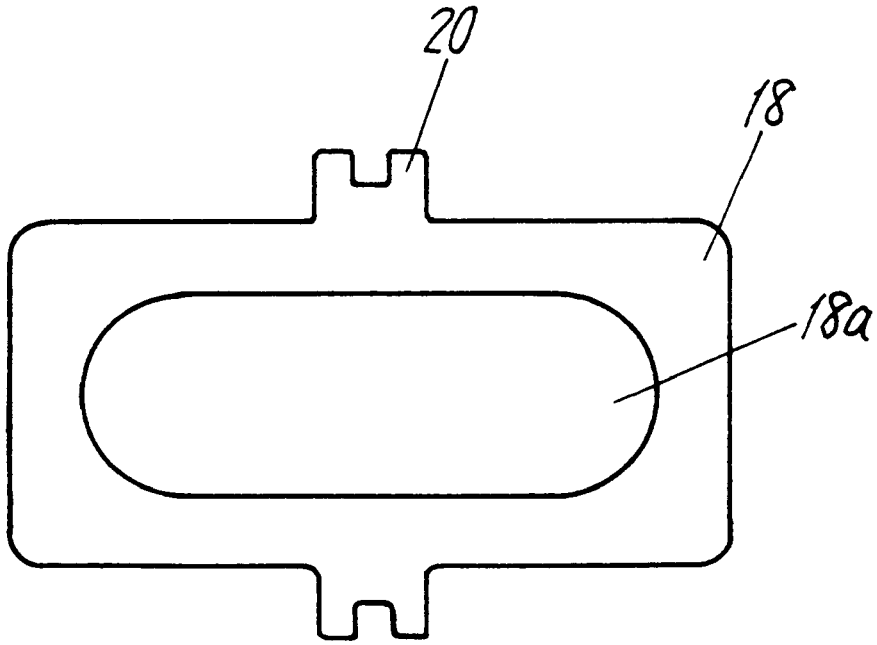
FIG. 8 is a plan view of yet another example of the reinforcing electrode plate.

As shown in FIG. 8, the opening 18*a* may be an opening having a larger width in the horizontal direction than that in the vertical direction. The shape of the opining 18G may be an ellipse, rectangle, and polygon having five sides or more besides oval.

Embodiment 2

Figure 9:
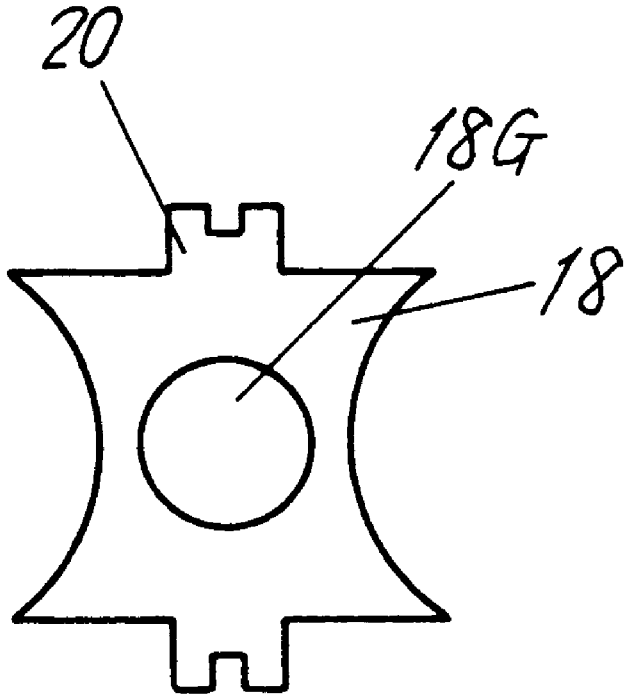
FIG. 9 is a plan view of still another example of the reinforcing electrode plate.

The peripheral shape of the reinforcing electrode plate 18 is not limited to that having substantially the same outline as that of the opening portion 13*b* of the focusing electrode 13 (FIGS. 5 to 8). The reinforcing electrode plate 18 may be formed so as to have an opening 18G surrounding only a path for the center electron beam 8G and to have a circular-arc shape at its both sides as shown in FIG. 9.

In this case, the side electron beams 8R and 8B are surrounded partially by the circular arc only at the boundary side with the center electron beam 8G.

According to such a configuration, the same effect as that described above can be obtained. Additionally, the amount of material used for the reinforcing electrode plate can be reduced.

As described above, the opening 18G may be formed so as to have a shape having the same opening width in the horizontal direction and in the vertical direction, a shape having a smaller opening width in the horizontal direction than that in the vertical direction, a shape having a larger opening width in the horizontal direction than that in the vertical direction, or the like.

Embodiment 3

Figure 10:
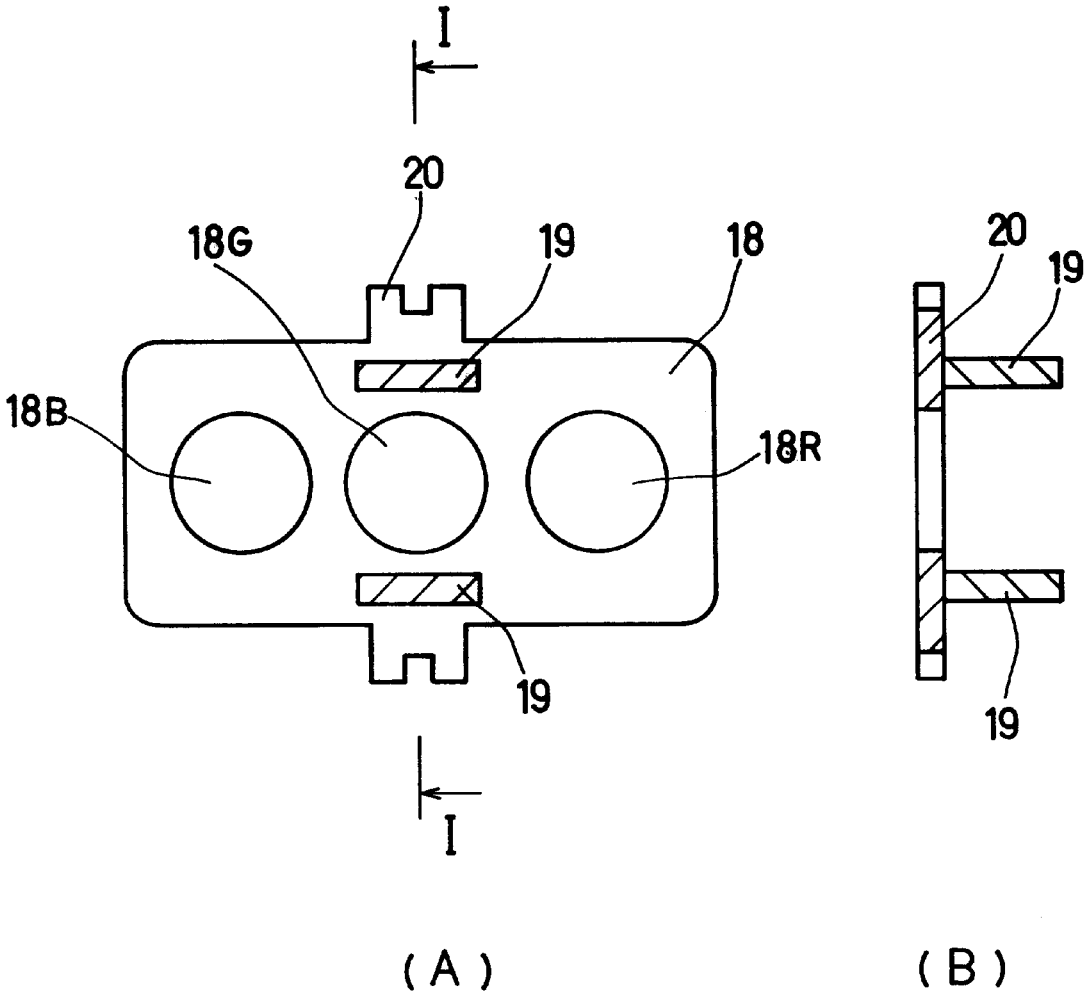
FIG. 10(A) is a plan view of yet another example of the reinforcing electrode plate.
FIG. 10(B) is a sectional view taken on line I—I in FIG. 10(A) and seen from the arrow direction.

Further, as shown in FIG. 10, the effect of the electric field lens of the reinforcing electrode plate 18 can be adjusted by providing a hood 19, projecting forward or backward with respect to the traveling direction of the electron beams, at the circumferential part of the openings in the reinforcing electrode plate 18.

The hood 19 is formed by attaching a plate-like object made of the same material as that of the reinforcing electrode plate 18 to the reinforcing electrode plate 18 by welding or the like.

Figure 11:
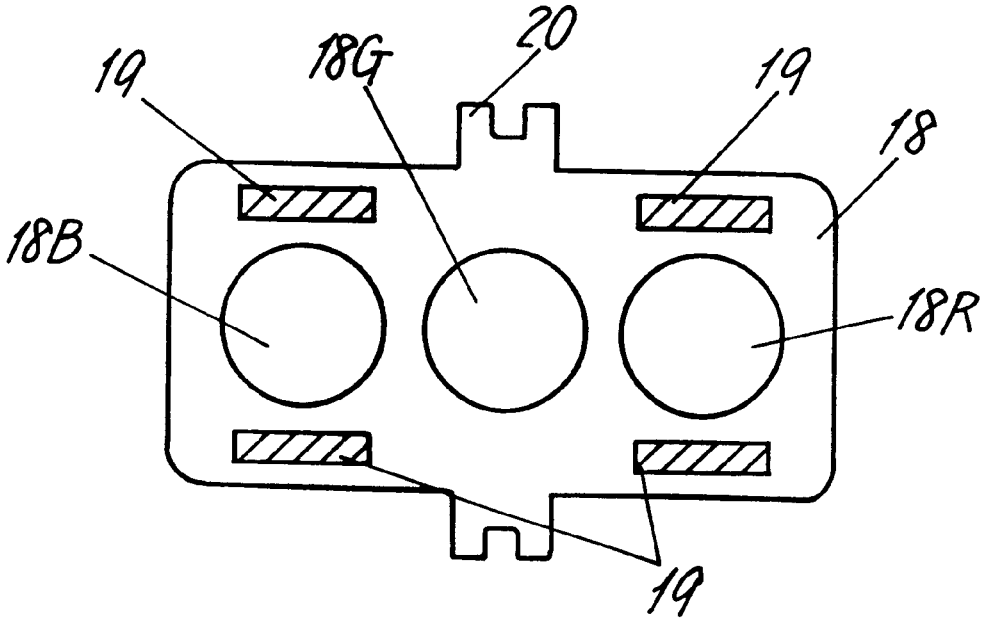
FIG. 11 is a plan view of further another example of the reinforcing electrode plate.
Figure 12:
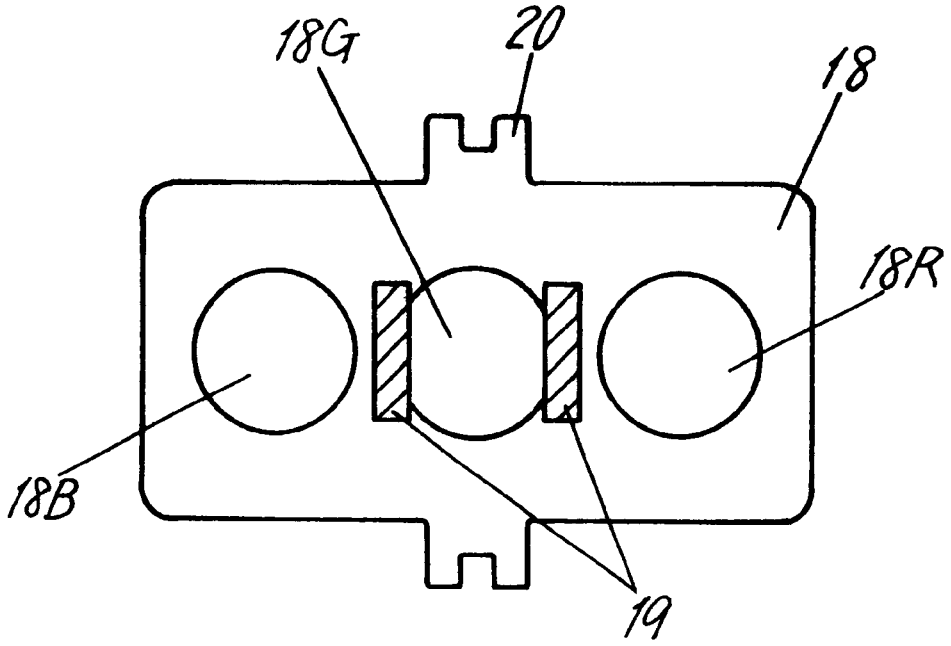
FIG. 12 is a plan view of still another example of the reinforcing electrode plate.

As shown in FIGS. 10 to 12, the hood 19 should be arranged so as to obtain a suitable effect of an electric field lens according to the purpose, for example, at positions above and below the center opening 18G (FIG. 10), at positions above and below the side openings 18R and 18B (FIG. 11) respectively, or at positions to the right and left of the center opening 18G (FIG. 12), or the like. Additionally, it is preferable that the hood 19 is attached onto a surface of the reinforcing electrode plate 18 at the main lens side for adjusting the effect of the electric field lens.

Figure 13:
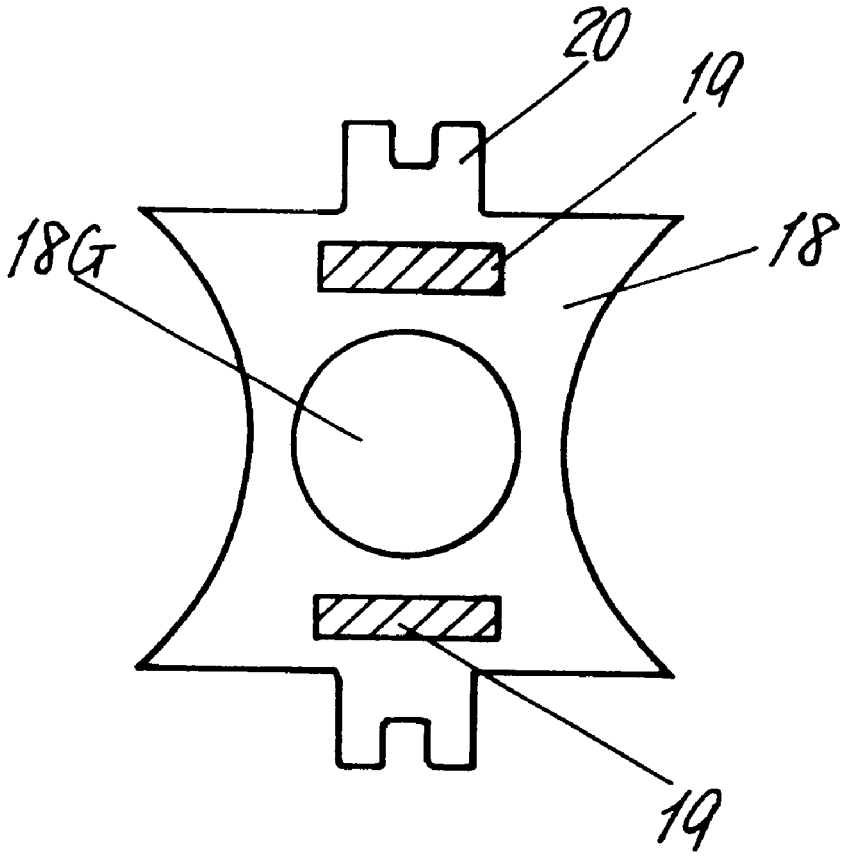
FIG. 13 is a plan view of yet another example of the reinforcing electrode plate.
Figure 14:
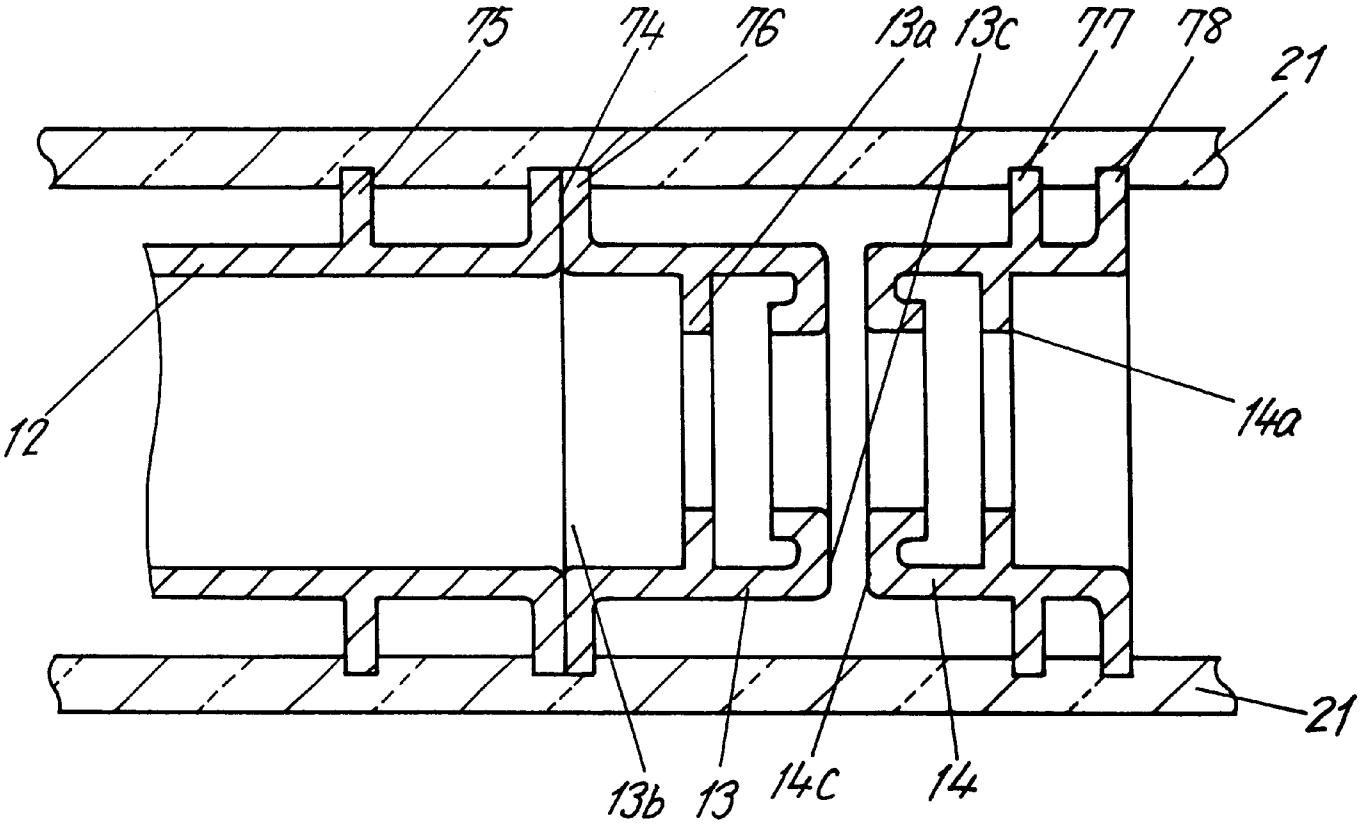
FIG. 14 PRIOR ART
FIG. 14 is an enlarged sectional view of part of a conventional electron gun.

Further, as shown in FIG. 13, a hood 19 may be combined with the reinforcing electrode plate 18 having only the center opening 18G described in Embodiment 2.

In each embodiment described above, an electron gun is provided with a cup-type focusing electrode and a cup-type final accelerating electrode, each of which has a bottom portion at one end. However, the shape of the focusing electrode or the final accelerating electrode is not limited to this. A shape in which a planar plate provided with electron-beam through-holes is inserted into an intermediate portion inside a cylinder may be employed.

The invention may be embodied in other forms without departing from the spirit or essential characteristics thereof.

The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A color cathode-ray tube comprising an electron gun having a main lens comprising a focusing electrode and a final accelerating electrode, each of which has an opening portion on one end and a bottom having an electron-beam through-hole on the other end, the focusing electrode and the final accelerating electrode being arranged with their bottoms opposing each other at a predetermined distance, at least one of the focusing electrode and the final accelerating electrode having a field forming electrode plate inside the electrode at a position recessed from its bottom and a reinforcing electrode plate, the reinforcing electrode plate having a supporting portion and at least one opening through which an electron beam passes being connected to the opening portion side of said at least one of the focusing electrode and the final accelerating electrode, and the reinforcing electrode plate being fixed to an insulating support with the supporting portion projecting further outside than a peripheral surface of the opening portion.

2. The color cathode-ray tube according to claim 1, wherein the reinforcing electrode plate has only one opening through which a center electron beam out of three electron beams passes, both sides of the reinforcing electrode plate being formed in a nearly circular-arc shape, and each portion having the nearly circular-arc shape partially surrounding an electron beam located at each side of the center electron beam.

3. The color cathode-ray tube according to claim 1, wherein the reinforcing electrode plate has a hood adjacent at least one of the three electron beams, and the hood projects forward or backward with respect to the traveling direction of the electron beam.

4. The color cathode-ray tube according to claim 2, wherein the reinforcing electrode plate has a hood adjacent at least one of the three electron beams, and the hood projects forward or backward with respect to the traveling direction of the electron beam.

* * * * *